United States Patent [19]

Larkin et al.

[11] 4,214,083

[45] Jul. 22, 1980

[54] PROCESS FOR DECOLORIZING LUBRICATING OIL ADDITIVES

[75] Inventors: John M. Larkin, Austin, Tex.; William P. Cullen; Rodney L. Sung, both of Fishkill, N.Y.; Benjamin H. Zoleski, Beacon, N.Y.

[73] Assignee: Texaco Inc., White Plains, N.Y.

[21] Appl. No.: 896,840

[22] Filed: Apr. 17, 1978

Related U.S. Application Data

[63] Continuation-in-part of Ser. No. 757,401, Jan. 6, 1977, abandoned.

[51] Int. Cl.[2] ..... C07D 473/16; C07D 403/04; C07D 215/10

[52] U.S. Cl. ..... 544/277; 544/347; 546/182; 546/255; 568/23; 568/40

[58] Field of Search ..... 260/297 R, 290 R, 290 HL, 260/608, 609 R; 252/50, 42.7; 546/182, 255; 544/277, 347

[56] References Cited

U.S. PATENT DOCUMENTS

| | | | |
|---|---|---|---|
| 3,969,235 | 7/1976 | Sung et al. | 252/42.7 |
| 4,100,086 | 7/1978 | Larkin et al. | 252/50 |

*Primary Examiner*—Alan L. Rotman

*Attorney, Agent, or Firm*—Carl G. Ries; Robert A. Kulason; Henry W. Archer

[57] ABSTRACT

Lubricating oil additives, including the calcium salts of sulfurized alkylphenols and dispersants consisting of the reaction products of halogenated polyalkylenes and heterocyclic amines, are substantially decolorized by treatment with small amounts of alkali metal hydrides in a polar solvent at 20° to 120° C. Color improvement is obtained at concentrations ranging from 1 to 75 parts of an alkali metal hydride per 1000 parts of additive.

4 Claims, No Drawings

PROCESS FOR DECOLORIZING LUBRICATING OIL ADDITIVES

CROSS REFERENCE TO CO-PENDING APPLICATION

This application is a continuation-in-part of copending application Ser. No. 757,401, Jan. 6, 1977 and now abandoned.

BACKGROUND OF THE INVENTION

Field of the Invention

This invention relates to lubricant oil additives and more particularly to a process for decolorizing such additives.

Many lube oil additives are known to perform their functions properly despite their dark color which they impart to the oils they improve. Dark-colored lubricating oils generally are not acceptable to consumers. Accordingly, there is a need for a process whereby dark-colored lubricating oil additives can be decolorized so as not to darken such oils.

SUMMARY OF THE INVENTION

It now has been discovered, in accordance with the present invention that certain lubricating oil additives can be substantially decolorized by treatment with alkali metal hydrides.

The process of this invention is particularly effective for decolorizing additives described in coassigned U.S. Pat. Nos. 3,528,917 issued Sept. 15, 1970 and 3,969,235 issued July 13, 1976, both of which are incorporated by reference in the present application The first of these patents describes a sulfurized normal calcium alkylphenolate, prepared by reacting (1) an alkylphenol of the formula:

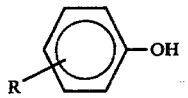

where R represents one or two monovalent saturated aliphatic hydrocarbon radicals of from 4 to 100 carbons and where at least one ortho or para positions remains unsubstituted, (2) a calcium alkoxyalkoxide of the formula $Ca(O—A—OR')_2$ where A is a divalent saturated aliphatic hydrocarbon radical (alkanediyl) of from 1 to 6 carbon and R' is alkyl of from 1 to 25 carbons and (3) sulfur at a temperature between about 0° and 250° C. utilizing a mole ratio of alkylphenol to calcium alkoxyalkoxide of between about 1.1:1 and 2.2:1, preferably 2.0:1, and a mole ratio of alkylphenol to sulfur of between about 1:0.15 and 1:8 preferably between about 1:0.5 and 1:3.0. The sulfurized normal calcium alkylphenolate may be characterized by the following theoretical formula:

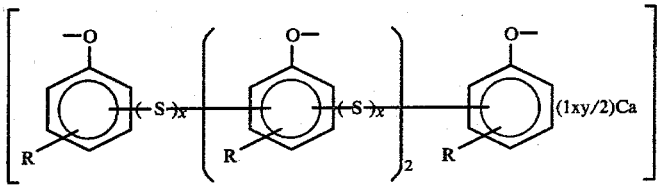

and where at least one ortho or para positions remains where R is as heretofore defined, x is an average integer of from about 1 to 4 and y is an average integer of from 0 to about 10. It is to be noted that x and y are defined as average integers and the foregoing formula is only set forth as hypothetical since sulfurized normal calcium alkylphenolate is in essence a complex mixture of monosulfide and polysulfides which can be accurately defined only in terms of process. In any case, the R group is primarily in the para position with the sulfur links mainly in the ortho position. Further, there is probably also a significant amount of covalent character to the calcium-oxygen bound. It is to be noted the calcium and sulfur contents of the sulfurized alkylphenolate component are respectively between about 1 and 8 wt. percent and 0.5 and 12 wt. percent.

Under advantageous reaction conditions, the sulfur is introduced into the reaction systems as a slurry in hydrocarbon lubricating oil, said slurry most preferably having a sulfur concentration of between about 10 and 25 wt. percent. In addition, the calcium alkoxyalkoxide reactant is advantageous introduced into the reaction system as a solution if not already a liquid to facilitate reactant contact. The solvent medium is desirable the corresponding alkoxyalkanol (if liquid) of the alkoxyalkoxide component. The concentration of the calcium alkoxyalkoxide in said solvent medium is advatangeously between about 20 and 60 wt. percent.

U.S. Pat. No. 3,969,235 describes overbased sulfurized calcium alkylphenolates produced by:

1. first contacting an alkylphenol

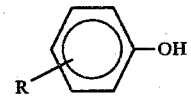

where R is alkyl of from 5 to 50 carbons with a first addition of calcium alkoxyalkoxide of the formula:

$$Ca(O—A—OR')2$$

where A is alkanediyl of from 1 to 6 carbons and R' is alkyl of from 1 to 25 carbons at a first temperature between about 200° and 420° F. utilizing a mole ratio of calcium alkoxyalkoxide to said alkylphenol of between about 0.225:1 and 0.45:1, 2. second contacting the resultant mixture with sulfur in the presence of hydrocarbon lubricating oil at a second temperature between about 400° and 460° F. utilizing a mole ratio of sulfur to initial alkylphenol of between about 0.5:1 and 8:1, said hydrocarbon oil in said second contacting constituting between about 13 and 30 wt. % of said reaction mixture and 3. subsequently third contacting the mixture with a second addition of calcium alkoxyalkoxide at said first temperature in a mole ratio of calcium alkoxyalkoxide to initial alkylphenol of between about 0.15:1 and 0.375:1 in sufficient so that the total calcium alkoxyalkoxide employed in the first and third contacting will total a mole ratio of calcium alkoxyalkoxide to initial alkylphenol of between about 0.5:1 and 0.6:1.

These additives can be lightened in color by treating them with minor amounts of alkali metal hydrides, particularly sodium borohydride, at temperatures ranging from 20° to 120° C. in the presence of a polar solvent such as an alcohol, an ether, water, an amine, or mixtures of these materials.

In a preferred embodiment of the invention, it was found advantageous to provide a nonpolar co-solvent in cases where the additive to be decolorized is soluble in hydrocarbons, but insoluble in polar solvents. Hydrocarbons such as heptane or chlorinated hydrocarbons such as carbon tetrachloride are suitable co-solvents.

The metal hydride is effective as concentrations of no greater than 1 part per 75 parts of the additive. Indeed some color improvement is likely at very low $NaBH_4$ concentrations, even as low as 1 part $NaBH_4$ per 1000 parts of additive.

Other substituted metal hydrides such as $LiALH_4$, $KBH_4$, $NaBH_3CN$ and mixtures thereof are suitable for the purpose of this invention.

The following examples are presented to demonstrate the significant contribution associated with the improvement of the present invention. The examples are, of course, intended to be illustrative rather than restrictive.

EXAMPLE I 5 parts by weight of $NaBH_4$ were added to 100 parts by volume of 50% of a 10% overbased (calcium 2-methoxy-ethoxide) sulfurized calcium alkyl phenolate in naphthenic diluent oil (A) and 100 parts of methyl cellosolve. The mixture was stirred at ambient temperature for 6 hours. Then the reaction product was filtered and stripped under vacuum. Analysis showed no change in sulfur or calcium contents and in total base number—a measure of the alkalinity of the solution, also a measure of overbasicity. For component "A" the sulfur content is 2.6% and the calcium is 3.2%. The product of this example was labeled L175-3008, blended in Railway Diesel Oil and tested by the ASTM color rating test along with the same oil containing untreated component A. The results of this test along with the Union Pacific Oxidation Test, G.E. Bronze Disk Friction Test, which are essential bench tests are given in Table I.

TABLE I

| Composition (wt. %) | Railway Diesel Oil | Railway Diesel Oil |
|---|---|---|
| L175-3008 | 6.7 | — |
| A | — | 6.7 |
| B | 3.2 | 3.2 |
| Amoco 150 Oil | 500 ppm | 500 ppm |
| Oil C | 2.1 | 2.1 |
| SNO-40 | 49.2 | 49.2 |
| Oil E | 39.4 | 39.4 |
| ASTM Color Rating | 4 pale (average) | 7 (claret red) |
| UPOT | | |
| % vis. Inc. | 19.3 | 19.3 |
| Wt. Loss | 7.8 mg. | 3.6 mg. |
| G. E. Bronze Disk | Excellent | Excellent |

EXAMPLE 2

The dispersants made from chlorinated polyisobutene (of about 1250 molecular weight) and 4-picoline, are about equivalent in performance (in crankcase motor oils for gasoline engines) to commercial succinimide dispersants and are superior to some other commercial dispersants. The picoline-derived dispersant is also inexpensive to manufacture. Unfortunately, when used in fully formulated oils, it results in much darker colors than desired. The following procedure describes how the color of the additive was lightened by sodium borohydride.

One gram of sodium borohydride was dissolved in 60 ml. of ethanol. This solution was added slowly over a 15 min. period to a solution of 75.0 g. Polyisobutenyl 4-picolinium chloride in 100 ml. of n-heptane maintained at 40°–45° C. under nitrogen. Then it was heated at 55° C. for 10 hours. Heptane (175 ml.) followed by methanol (125 ml.) was added. Gas evolved indicating that the NaBH has been present in excess, and not all had reacted. The mixture was filtered. The heptane layer was separated and the heptane removed in vacuo at 88° C. The yield of lighter colored dispersant was 73 g. The nitrogen content was virtually unaffected (0.48% before vs. 0.50% after). The following table compares properties of the dispersant before and after $NaBH_4$ treatment when present at 4.00 wt. % in a fully formulated motor oil. The data in the Table shows a color improvement of 40% with a turbidity lowered by 30%.

| | ASTM Color | | Bench BVC Test, (percent turbidity) | |
|---|---|---|---|---|
| | Dilute | Nondilute | Test Oil | Ref Oil |
| Before $NaBH_4$ | 7.5 | 8.0 | 5.0 | 3, 34, 60 |
| After $NaBH_4$ | 4.5 | 8.0 | 3.5 | 2, 15, 45 |

1. The lower the percent turbidity, the better the dispersant.

2. The color is determined by comparing the intensity of the sample with those on a standard scale. The darker the color, the higher the number. A number greater than 8 cannot be read in the normal manner as it is off the scale of the standards. Consequently, the sample is diluted in a ratio of 15 parts of sample to 85 parts water-white kerosine. The number so obtained is referred to as ASTM (dilute) color.

Substantially similar results are obtained when $NaBH_4$ is replaced by $LiAlH_4$, $KBH_4$, and $NaBH_3CN$.

Various other dispersants prepared from halogenated polybutenes, pyridine, and pyridine bases and with which the process of this invention also is effective, are described and claimed in coassigned U.S. Pat. No. 4,100,086 issued July 11, 1978.

What is claimed is:

1. A process for decolorizing a lube oil additive of the group of (1) overbased sulfurized calcium alkylphenolates produced by: first, contacting an alkylphenol of the formula:

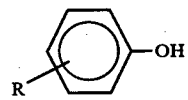

where R is alkyl of from 5 to 50 carbons with a first addition of calcium alkoxyalkoxide of the formula:

$Ca(O—A—OR')_2$ where A is alkanediyl of from 1 to 6 carbons and R' is alkyl of from 1 to 25 carbons at a first temperature between about 200° F. and 420° F. utilizing a mole ratio of calcium alkoxyalkoxide to said alkylphenol of between about 0.225:1 and 0.45:1, second, contacting the resulting mixture with sulfur in the presence of hydrocarbon lubricating oil at a second temperature between about 440° and 460° F. utilizing a mole ratio of sulfur to initial alkylphenol of between about 0.5:1 and 8:1, said hydrocarbon oil in said second contacting constituting between about 13 and 30 wt. % of said reaction mixture and subsequently, third, contacting the mixture with a second addition of calcium alkoxyalkoxide at said first temperature in a mole ratio of calcium alkoxyalkoxide to initial alkylphenol of between about 0.15:1 and 0.375:1 in sufficient amount so that the total calcium alkoxyalkoxide employed in the first and third contacting will total a mole ratio of calcium alkoxyalkoxide to initial alkylphenol of between about 0.5:1 and 0.6:1, and (2) the reaction product of halogenated polyalkylenes having a molecular weight ranging from about 300 to 5000 or copolymers thereof with an excess of an aromatic heterocyclic amine reacted at a temperature of around 80° to 160° C. in the presence of an alkali or alkaline earth metal salt; the amount of heterocycle reacted being in excess of 1.5 to 30 moles per mole of said halogenated polyalkylenes with the amount of said metal being in an amount ranging from 0.2 to 3.0 moles per mole of said polyalkylenes; said polyalkylene being a chlorinated polyalkylene, said heterocyclic amine being pyridine, pico line, methylethylpyridine, quinoline, isoquinoline, phenazine, purine or pyridine and said salt being sodium carbonate, sodium bicarbonate, or sodium gluconate, which process comprises contacting in a polar solvent said additive with 1 to 75 parts by weight of an alkali metal hydride per 1000 parts of said additive and separating the treated additive from said polar solvent.

2. The process of claim 1, wherein said additive is soluble in hydrocarbons but insoluble in polar solvents and further including using a non-polar cosolvent.

3. The process of claim 1, wherein said borohydride is sodium borohydride.

4. The process of claim 1, wherein said contacting is carried out at 20° to 120° C.

* * * * *